United States Patent [19]

Monti

[11] 4,216,025

[45] Aug. 5, 1980

[54] SUGAR CRYSTALLIZATION PROCESS

[76] Inventor: Anthony Monti, c/o Revere Sugar Corporation, 120 Wall St., New York, N.Y. 10005

[21] Appl. No.: 26,736

[22] Filed: Apr. 3, 1979

Related U.S. Application Data

[63] Continuation-in-part of Ser. No. 862,021, Dec. 19, 1977, abandoned.

[51] Int. Cl.[2] ..... C13F 1/00

[52] U.S. Cl. ..... 127/61; 127/15; 127/62

[58] Field of Search ..... 127/15, 61, 62

[56] References Cited

U.S. PATENT DOCUMENTS

| | | | |
|---|---|---|---|
| 1,670,101 | 5/1928 | Dickerson | 127/61 |
| 3,477,874 | 11/1969 | Repsdorph et al. | 127/61 X |
| 3,582,399 | 6/1971 | Black | 127/61 X |
| 3,704,169 | 11/1972 | Woodruff et al. | 127/62 |
| 3,706,599 | 12/1972 | Woodruff et al. | 127/62 |
| 3,956,009 | 5/1976 | Lundquist, Jr. et al. | 127/61 X |

*Primary Examiner*—Frank W. Lutter
*Assistant Examiner*—Roger F. Phillips
*Attorney, Agent, or Firm*—Kenyon & Kenyon

[57] ABSTRACT

Sugar is crystallized from aqueous solutions thereof by spraying a supersaturated sugar solution or syrup at elevated temperature into a high velocity air stream, at ambient temperature, whereby crystallization and drying occur rapidly and the sugar crystals are entrained in the air stream and carried away from the spray zone in pneumatic transport.

7 Claims, 1 Drawing Figure

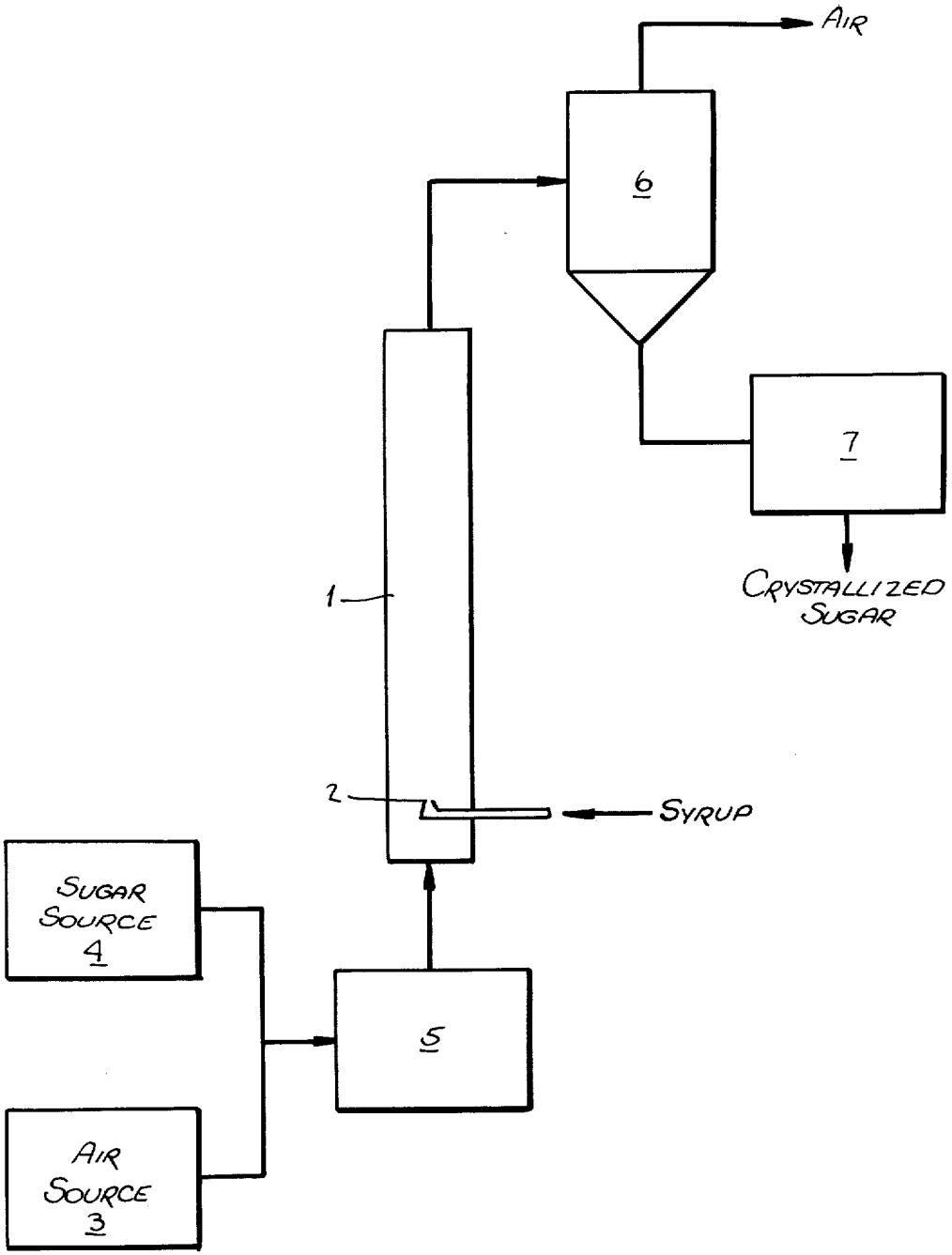
AIR
6
7
CRYSTALLIZED SUGAR
1
2
SYRUP
SUGAR SOURCE 4
5
AIR SOURCE 3

SUGAR CRYSTALLIZATION PROCESS

This application is a continuation-in-part of U.S. patent application Ser. No. 862,021, filed Dec. 19, 1977 and now abandoned.

The present invention is concerned with a novel process for crystallizing sugar from aqueous solutions or syrups thereof. More particularly, this invention is concerned with a novel processs for crystallizing sucrose syrups to form finely divided sucrose crystals.

In the past, crystallizable sugar, and especially sucrose, has been crystallized from sugar syrups by a fractional crystallization process from bulk syrup. In such a process the syrup is evaporated under vacuum to reduce the vaporization temperature and avoid inversion of the sugar to form uncrystallizable sugars (e.g. invert sugar from sucrose). Subsequently, considerable effort has been devoted to developing processes for crystallizing sugar from syrups through the use of spray drying techniques. Processes of this character have been disclosed, for example, in U.S. Pat. No. 3,674,557 and references cited therein. In general, all of these processes involve the use of substantial quantities of seed solids (as much as 50 percent or more of the crystallized product) which commonly are obtained by recycle of the crystallized sugar. In addition, many of the known processes employ air at elevated temperatures to ensure the evaporation of all of the water present in the syrup. Still other processes, e.g. those described by Reimers in U.S. Pat. No. 3,140,201 and by Oikawa in U.S. Pat. No. 3,271,194, employ complicated equipment.

It is an object of the present invention to provide a simple method for crystallizing sugar from syrups thereof.

It is another object of this invention to provide a method for crystallizing sugar from syrups thereof which employ simple equipment.

Still other objects of the present invention will be evident from the ensuing specification, examples and claims.

In essence, the present invention comprises spraying a supersaturated sugar solution or syrup at elevated temperature into a high velocity gas stream at ambient temperature, effecting crystallization of sugar from the thus-formed syrup droplets while entrained in pneumatic transport in the gas stream, and removing sugar crystals from the spray zone by pneumatic transport. This procedure is most easily carried out by passing air through a conduit having mounted therein one or more nozzles adapted to direct a spray of a sugar syrup or solution into the air stream, and thereafter discharging from the conduit crystals of sugar. Although not necessary, seed crystals of sugar may desirably be entrained in pneumatic transport in the gas stream before introducing the sugar syrup into the air stream. The crystallized sugar which is obtained in accordance with the process of this invention is in the form of high density bead-like agglomerates. As a consequence, the crystallized sugar is very free-flowing, despite having very small size particles.

The drawing illustrates, in schematic form, equipment which can be employed to carry out the process of the present invention. In essence, the equipment comprises, in combination, a source of pulverized solid sugar for use as seed when desired, a source of pneumatic fluid, e.g. air, means for admixing solid seed sugar with the pneumatic fluid, a conduit through which the pneumatic fluid is transported, optionally carrying seed sugar in pneumatic transport, a means for directing a spray of a sugar syrup into the pneumatic fluid, means for separating crystallized sugar from the pneumatic fluid and, if necessary, means for reducing the moisture content of the crystalline sugar.

As is shown in the drawing, ambient air (after optional filtering, dehumidification or other pretreatment) is introduced into conduit 1. The air flow may be established by use of a blower and/or by drawing a vacuum at the discharge end of conduit 1. In the drawing, conduit 1 is shown as having a generally vertical orientation, and the air is shown as being passed upwardly through the conduit. This is not essential to the present invention, and conduit 1 may have any orientation, including a horizontal orientation, and the air stream may be passed through the conduit in any direction, e.g. upwardly or downwardly through a generally vertical conduit.

A supersaturated syrup at elevated temperature is introduced into conduit 1 through nozzle 2, located in conduit 1 and spaced from the inlet of conduit 1, a distance such that turbulence resulting from introduction of the air into conduit 1 has subsided. The spray particles from nozzle 2 are instantaneously chilled, resulting in the crystallization of the sugar in the syrup. Heat of crystallization causes evaporation of the water present in the syrup. The crystallized sugar particles are entrained in the air and are carried away from nozzle 2 in pneumatic transport. As they travel through conduit 1 they contact one another, allowing the formation of agglomerates of crystallized sugar droplets to occur. In addition, depending upon the temperature of the entraining fluid, the temperature and amount of syrup liquid, and the residence time of the crystallized sugar droplets and the resulting agglomerates in conduit 1, drying of the crystallized sugar to a greater or lesser extent may occur.

It is a feature of the process of this invention that, as a consequence of the rapid chilling of the supersaturated syrup and contact of the cyrstallized sugar particles while in pneumatic transport, very fine, high density beads comprising agglomerates of crystallized sugar droplets are obtained.

Ordinarily, the crystallization process of this invention does not require the use of seed particles. The syrup is at elevated temperature and pressure compared to the air passing through conduit 1, and it experiences a sudden drop in pressure (at least about 50 lb./in.$^2$) and temperature (about 200° F.) when passed through spray nozzle 2. The combined pressure and temperature differentials cause the syrup droplets to "shock seed", and spontaneously form sugar crystallites which then promote complete crystallization. In some cases, small amounts of externally supplied solid seed crystals may be required, but in that event the amount of such seed crystals should not exceed about 3 weight percent of the solid crystalline sugar produced by the process of this invention, with amounts of less than 0.5 weight percent being preferred. Where such seed particles are employed, they may be entrained in pneumatic transport in the air prior to introduction of the air into conduit 1. For example, air from air source 3 and seed sugar from sugar source 4 may be admixed in mixer 5 and the resulting mixture fed to conduit 1 as is shown in the drawing.

The crystallized sugar particles formed in accordance with this invention are separated from the entraining fluid and, if necessary, undersized "dust", as by use of a cyclone separator 6. Optionally, the particles may be dried as necessary in dryer 7, following which they are shipped to storage, to packaging operations, or to any other suitable destination.

As is evident from the foregoing, the process of the present invention is much simpler in concept, equipment and mode of operation than are the crystallization processes of the prior art. Furthermore, it avoids the need for high amounts of seed crystals, and in most instances it eliminates the need for seed crystals. Finally, it provides high density beads of crystallized sugar having excellent flow properties.

The process of this invention is to be distinguished from that of Reimers et al, as disclosed in U.S. Pat. No. 3,140,201. In this prior art process, a mixture of a solid (sugar) and a syrup is introduced into a toroidal grinding chamber, and is violently transported through the chamber by air at sonic or supersonic velocity. The resulting violent contact of the entrained agglomerates of sugar and syrup causes the agglomerates to be reduced in size and, after sufficient size reduction the smaller particles are withdrawn through a classifying section. By eliminating premixing of solid sugar and syrup, the process of this invention avoids the need for grinding and, hence the need for high velocity air found by Reimers et al to be essential to effect size reduction. In the process of this invention, the air serves primarily as a cooling medium and as a transport medium for the crystallized sugar. It also incidentally serves as a drying medium to the extent evaporation of water is not effected by the heat of crystallization. As a consequence, applicant's process employs simpler equipment and does not require the use of high pressure air.

As is evident from the foregoing, the process of this invention relies, in part, on the principles of pneumatic transport. These principles are well known, and will not be further detailed here. Due to the simplicity of this invention, these known principles may be simply adapted through a few simple experiments to permit crystallization of any suitable sugar syrup.

The gaseous fluid can be any gaseous substance capable of entraining the crystallized sugar and supporting pneumatic flow. To the extent the product is intended for use as food or pharmaceutical products, it should also be non-toxic; and it should be essentially inert to the materials being agglomerated. As a practical matter, air is the preferred fluid due to its ready availability. On the other hand, gases such as nitrogen, argon, etc., theoretically could be employed.

Because one function of the fluid entraining medium is to remove water released during crystallization, it is highly desirable that the fluid have a relatively low moisture content (i.e. below about 42% relative humidity). This may be achieved through treatment in a known manner to reduce its moisture content. Some moderate heating may be employed, but ordinarily the air should not have a temperature in excess of 200° F., and preferably not in excess of 100° F. Air at "room" temperature (about 70°-90° F.) is preferred. The velocity of the fluid through the conduit is that velocity which is sufficient to entrain the solid crystallized sugar and transport the solid in pneumatic flow. To achieve this, linear velocities in excess of about 4000 ft./min. are desired, with velocities in the range of from about 6000 to about 8000 ft./min. being especially preferred.

The conduit employed in practicing the process of this invention may be made of any suitable material and it may have any desired cross-section. As is noted above, the conduit is preferably vertically oriented and it should be substantially straight to limit the opportunity for particles to contact conduit walls, especially in the region at and shortly downstream from nozzle 2, where particles may still be somewhat moist. Cylindrical conduits are preferred. Similarly, the size (i.e. diameter and length) of the conduit is not highly critical. The diameter is largely a function of the amount of material to be processed in a given time period, and the ability to maintain stable pneumatic flow. Further, the conduit should be sufficiently wide to permit introduction of the syrup spray without significant wetting of the conduit walls in the neighborhood of the spray. In general, it has been found that conduit diameters of from about 5 to about 15 inches (12.7 to 38.1 cm), and preferably from about 8 to about 11 inches (20.3 to 27.94 cm) may be employed.

Syrups which may be crystallized in accordance with this invention are supersaturated syrups of sucrose and other crystallizable sugars having similar properties, in particular similar crystallizing tendencies and hygroscopic properties. Other sugars, such as invert sugar and the like, which do not crystallize readily, may also be present in minor amounts. In general, the proportion of crystallizable sugar such as sucrose should be at least 85 weight percent, and preferably at least 90 weight percent of the solids content of the syrup. Furthermore, the syrup is supersaturated, i.e. it is heated to temperatures in excess of 250° F. (121° C.), and preferably at a temperature of about 260°-290° F., to concentrate the syrup to levels at which it would crystallize on cooling to room temperature. In general syrups having total solids contents of at least 75 weight percent are employed, with solids contents of at least about 85 weight percent being preferred. If the solid content of the syrup is greater than 95 weight percent, essentially all water is driven off by the exothermic heat of crystallization, whereas some drying may be required at lower syrup concentrations. Ordinarily, the entraining air is capable of providing this additional drying capacity, although in some cases (e.g. on humid days or when a syrup having reduced solids content is employed) drying of the crystallized sugar after recovery may be necessary.

The syrup is sprayed into the air in conduit 1 in any convenient manner, as by use of one or more nozzles in the conduit wall or positioned in the conduit. If a single nozzle is employed, it preferably is positioned at the axis of the conduit and oriented to direct the spray downstream, i.e. in the direction of flow of the air. If the nozzle is directed upstream, it may become coated with crystallized sugar. Several nozzles arranged around the wall of the conduit may be employed if desired. The nozzle may be of the airless or the pneumatic type. The size of the droplets of the syrup spray is not narrowly critical, and can vary depending upon the desired size of the crystallized sugar particles, with increased droplet size giving larger crystallized sugar particles. In general, droplets of the order of from about 50 to about 500 microns have been found suitable.

The length of the conduit following the spray zone is not highly critical. It provides a zone for agglomeration of the crystallized sugar and drying of the crystallized sugar where desired. In general, for a conduit having a width of 8 to 11 inches, it has been found that useful results are obtained where the spray zone is located 4 to 6 diameters from the inlet end and the total length of the straight section of the conduit is of the order of 40–50 diameters.

As is noted above, the crystallized sugar particles which are formed in accordance with this invention are separated from the entraining fluid, further dried if necessary, and then sent to storage, bagging or other operation. The crystallized sugar particles are typically smaller in size than crystallized sugar particles formed by other processes. Further, they are in a generally spherical, bead-like form, as a consequence of which they are free-flowing and non-caking.

Having generally described the invention, the following example is presented as being illustrative of the practice of the present invention.

EXAMPLE 1

The apparatus comprised a Spray Systems No. 49,267,650 nozzle axially mounted in an 8-inch diameter, vertical duct of circular cross-section. Air at ambient temperature was passed upwardly through the duct at a rate of about 7000 ft./min. A sugar syrup was formed by mixing 7 pounds of water with 25 pounds of a mixture of 91.8% sucrose and 8.2% invert sugar ("Drifond" made by SuCrest Corp.). The syrup was heated to 245°–268° F. and sprayed into the duct in the same direction as the flow of the air. The spray was in the form of a conical spray. The product was collected in a cyclone. The products obtained at various temperatures were:

245° F.—Weakly crystallized instant fondant
250° F.—More crystallized, stiffer fondant
255° F.—A mixture of clear and crystallized droplets
260° F.—Solidified clear droplets
265° F.—Mostly crystallized droplets
268° F.—Large droplets (1/16") crystallized

What is claimed is:

1. Method for crystallizing sugar from a super-saturated syrup of a crystallizable sugar, the syrup having a total solids content of at least 75 weight percent, and the syrup having a crystallizable sugar content of at least 85 weight percent of the total solids in said syrup, which comprises spraying said super-saturated syrup at elevated temperature greater than about 250° F. in the form of droplets of syrup having sizes of from about 50 to 500 microns, into a flowing gas stream having a temperature of less than about 200° F., whereby droplets of syrup crystallize to form solid sugar particles, and removing said droplets and crystallized solid sugar particles from the spray zone by pneumatic transport in said gas stream.

2. The method according to claim 1 wherein said syrup contains at least about 85 weight percent solids, and sucrose comprises at least 85 weight percent of the solids.

3. The method according to claim 2 wherein said syrup is at a temperature of about 260° to 290° F. and gas stream is at a temperature of about 70° to 80° F.

4. The method according to claim 1 wherein said gas stream is flowing through a vertically oriented conduit.

5. The method according to claim 1 wherein said gas is air.

6. The method according to claim 1 wherein the linear velocity of the gas is at least 4000 feet per minute.

7. The method according to claim 1 wherein seed crystals are entrained in the gas stream prior to introduction of said syrup, and wherein the amount of said seed crystals does not exceed 3 weight percent of the total solids of the crystallized solid sugar product.

* * * * *